US011707122B2

(12) United States Patent
Lockwood

(10) Patent No.: US 11,707,122 B2
(45) **Date of Patent: *Jul. 25, 2023**

(54) RETENTION DEVICE

(71) Applicant: Lerin Lockwood, Burnet, TX (US)

(72) Inventor: Lerin Lockwood, Burnet, TX (US)

(73) Assignee: Lerin Jane Lockwood, Burnet, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/480,149

(22) Filed: Sep. 21, 2021

(65) Prior Publication Data

US 2022/0000233 A1 Jan. 6, 2022

Related U.S. Application Data

(63) Continuation of application No. 15/202,491, filed on Jul. 5, 2016, now Pat. No. 11,122,874.

(60) Provisional application No. 62/188,528, filed on Jul. 3, 2015.

(51) Int. Cl.

| | |
|---|---|
| ***A45C 11/04*** | (2006.01) |
| ***A45C 11/16*** | (2006.01) |
| ***A45C 13/02*** | (2006.01) |

(52) U.S. Cl.

CPC ..... *A45C 11/16* (2013.01); *A45C 13/02* (2013.01)

(58) Field of Classification Search

CPC ..... B65D 25/106; A45C 11/16; A45C 13/02

USPC ..... 206/1.5, 6.1, 349, 372, 373, 308.1, 310, 206/454, 493, 566, 710

See application file for complete search history.

(56) References Cited

U.S. PATENT DOCUMENTS

| | | | | |
|---|---|---|---|---|
| 2,951,593 | A * | 9/1960 | Lake | A47F 5/02 108/103 |
| 4,415,080 | A * | 11/1983 | Romine | B25H 3/006 206/349 |
| 4,700,839 | A * | 10/1987 | Fujii | G11B 33/045 |
| 4,896,771 | A * | 1/1990 | Edwards | A45C 5/00 206/349 |
| D327,411 | S * | 6/1992 | Donalies | D8/346 |
| 6,082,601 | A * | 7/2000 | Standish | F41C 33/06 70/164 |
| 6,112,894 | A * | 9/2000 | Kikuchi | G11B 33/045 |
| 6,948,343 | B2 * | 9/2005 | Williamson | F41A 9/61 70/2 |
| 7,380,656 | B2 * | 6/2008 | Yeh | G11B 33/045 |
| 8,157,092 | B2 * | 4/2012 | Christopher | B25G 1/085 206/349 |
| 2015/0021216 | A1 * | 1/2015 | Blagojevic | B65D 43/0214 206/265 |

* cited by examiner

*Primary Examiner* — Luan K Bui
(74) *Attorney, Agent, or Firm* — Joseph Farco

(57) ABSTRACT

Embodiments of a retention device are described. In an embodiment, the retention device includes a retention base having a stem protruding outwardly from a first surface of the retention base. Additionally, the retention device may include a retention closure configured to engage the retention base, the retention closure having a hole for receiving the stem. The retention device may also include a receiver coupled to the stem, the receiver configured to receive a retention member for retaining the retention closure in engagement with the retention base.

13 Claims, 8 Drawing Sheets

RETENTION DEVICE

RELATED APPLICATIONS

This application is a continuation of U.S. patent application Ser. No. 15/202,491, filed on Jul. 5, 2016 and which issued as U.S. Pat. No. 11,122,874 on Sep. 21, 2021, which itself claims the benefit of U.S. Provisional Patent Application Ser. No. 62/188,528, filed on Jul. 3, 2015, the disclosures of each of which being incorporated herein by reference in their entirety.

TECHNICAL FIELD

Embodiments of the invention are directed, in general, to valuables enclosures and, more specifically, to retention devices and methods of using the same.

BACKGROUND

Jewelry is small, valuable, and easy to lose. Because of its value, jewelry is often a target for theft. Active people may wish to remove jewelry during activities to prevent its damage or loss. For example, when working out at a gym or going for a run, an athlete may wish to remove jewelry to prevent personal injuries, or damage to the jewelry. One problem facing active people, is what to do with the jewelry once it is removed. If the jewelry is left in a locker it may be at risk of theft. If it is placed in a pocket it may be lost. Similarly, other valuables may be easy to lose and difficult to retain, including for example, medications, coins, etc.

Ring cases have previously been designed, but fail to adequately protect jewelry sufficiently to meet the needs of active persons. One previous ring case included a base and a standard over which a ring could rest. A portion of the standard included an abrasive material. The problem with this solution was than the ring case was not easily manageable or attachable to any sort of securing device, such as a clamp, clip, keychain, etc. Because the case was not substantially larger than the ring itself, the entire case and ring may be relatively easy to misplace. Additionally, the base did not lock into the cap. Rather, it simply screwed in to the cap, which could be easily displaceable.

Another prior solution involved a locket-type ring case attached to a necklace. This locket included a front and a back portion which were connected by a hinge. The front did not lock to the back with any sort of positive locking mechanism, which makes the locket-type case unsuitable for use in physical activities.

Another prior device included a ring case with a top and a bottom, which were simply pressed together. The bottom has a loop for attaching a keychain, etc., but does not operate to lock the top to the bottom in any way. Further, the ring case allows jewelry to move freely within the case, which can cause rattling, and or damage to the jewelry. For example, the rattling could loosen jewels or jewel settings, such as prongs on a ring. The ring case does not have the ability to hold jewelry in the ring case in a locked position.

SUMMARY

Embodiments of a retention device are described. In an embodiment, the retention device includes a retention base having a stem protruding outwardly from a first surface of the retention base. Additionally, the retention device may include a retention closure configured to engage the retention base, the retention closure having a hole for receiving the stem. The retention device may also include a receiver coupled to the stem, the receiver configured to receive a retention member for retaining the retention closure in engagement with the retention base.

BRIEF DESCRIPTION OF THE DRAWINGS

Figure 1:
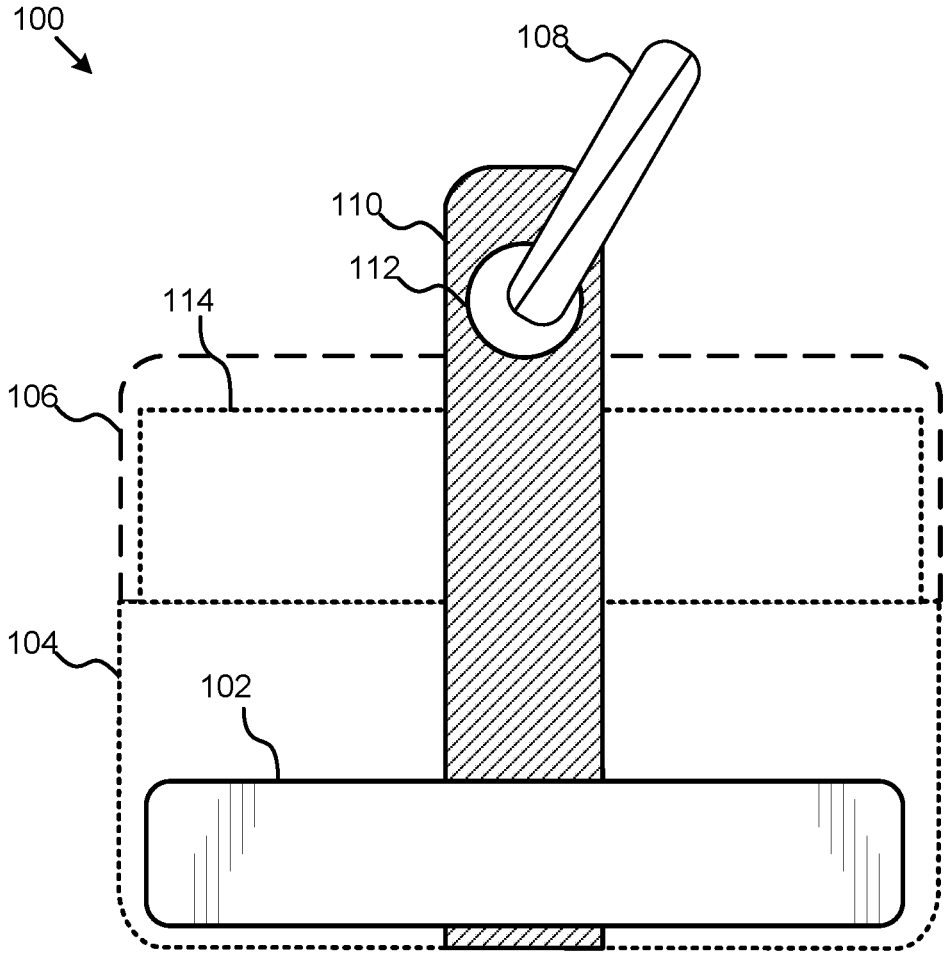

Having thus described the invention in general terms, reference will now be made to the accompanying drawings, which are not necessarily drawn to scale, and wherein:

FIG. 1 is a cross-section view diagram illustrating one embodiment of a retention device.

Figure 2:
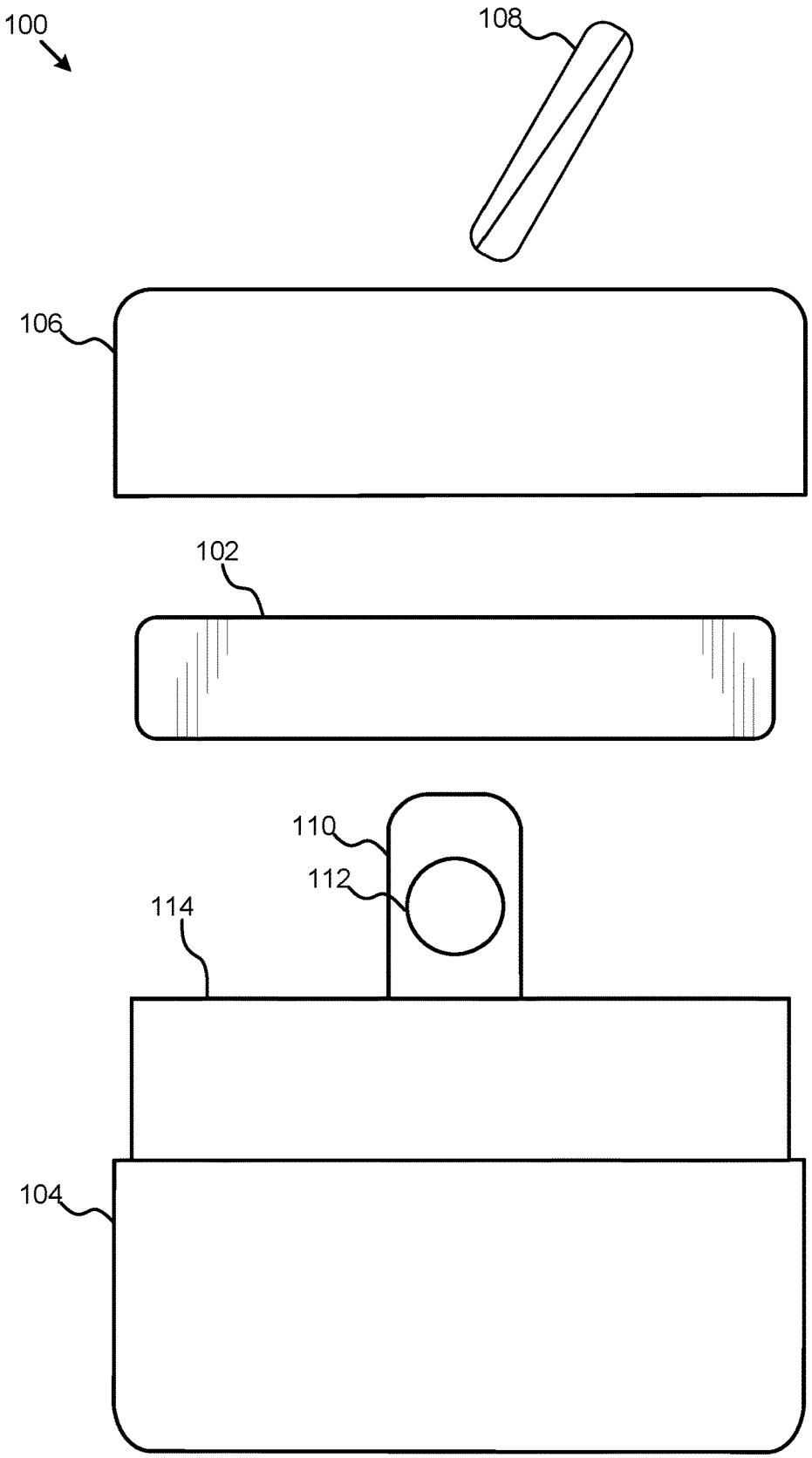

FIG. 2 is an exploded view diagram illustrating one embodiment of a retention device.

Figure 3:
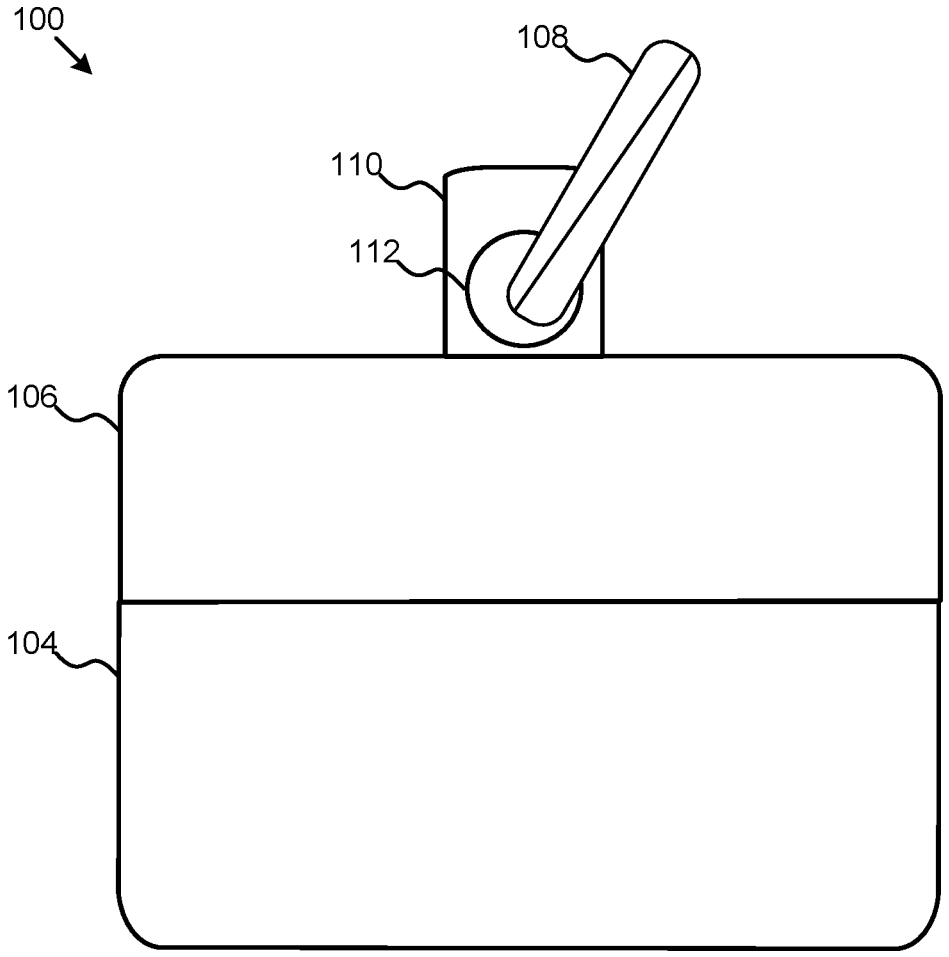

FIG. 3 is a front view diagram illustrating one embodiment of a retention device.

Figure 4:
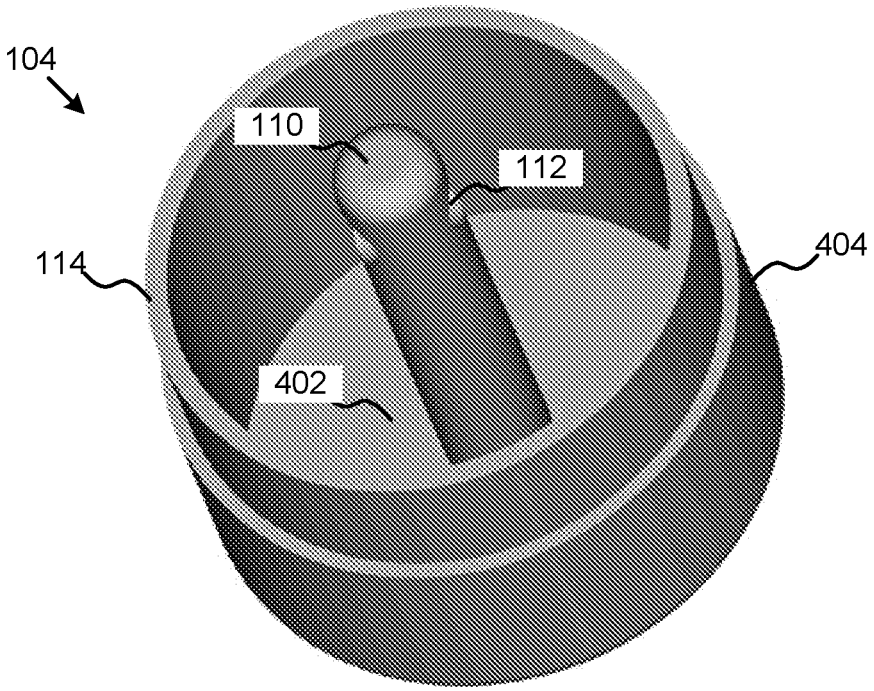

FIG. 4 is a perspective view diagram illustrating one embodiment of a retention base.

Figure 5:
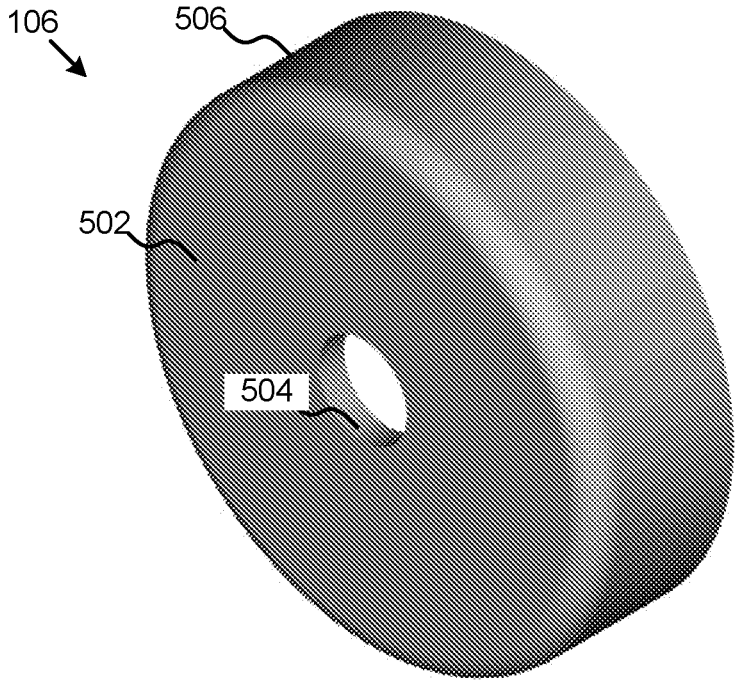

FIG. 5 is a perspective view diagram illustrating one embodiment of a retention closure.

Figure 6:
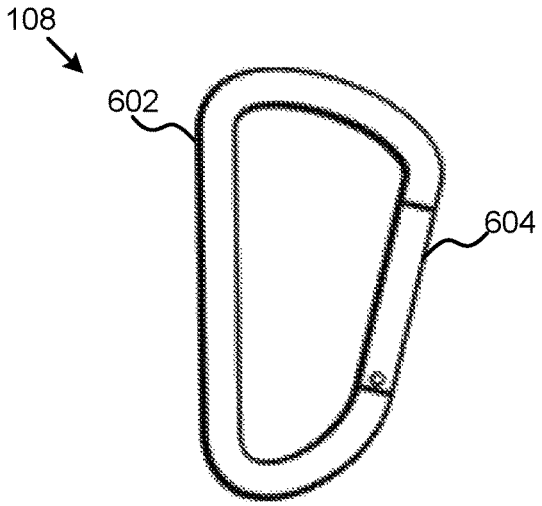

FIG. 6 is a perspective view diagram illustrating one embodiment of a retention member.

Figure 7:
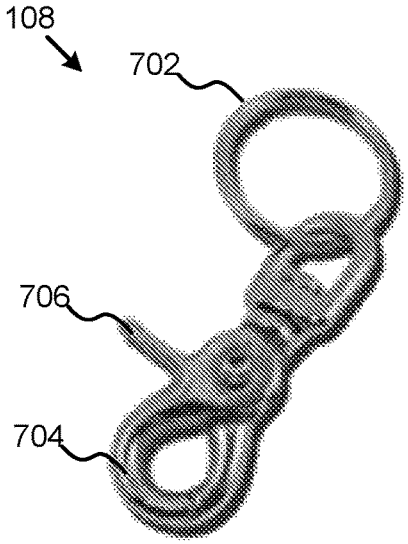

FIG. 7 is a perspective view diagram illustrating one embodiment of a retention member.

Figure 8:
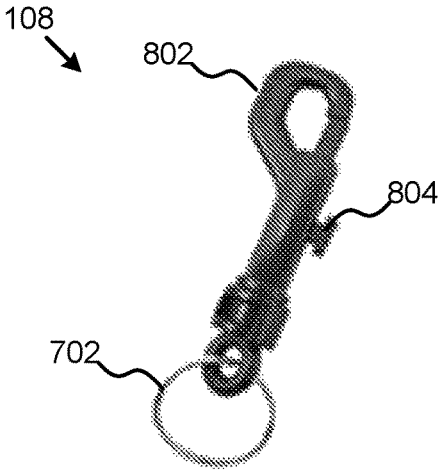

FIG. 8 is a perspective view diagram illustrating one embodiment of a retention member.

Figure 9:
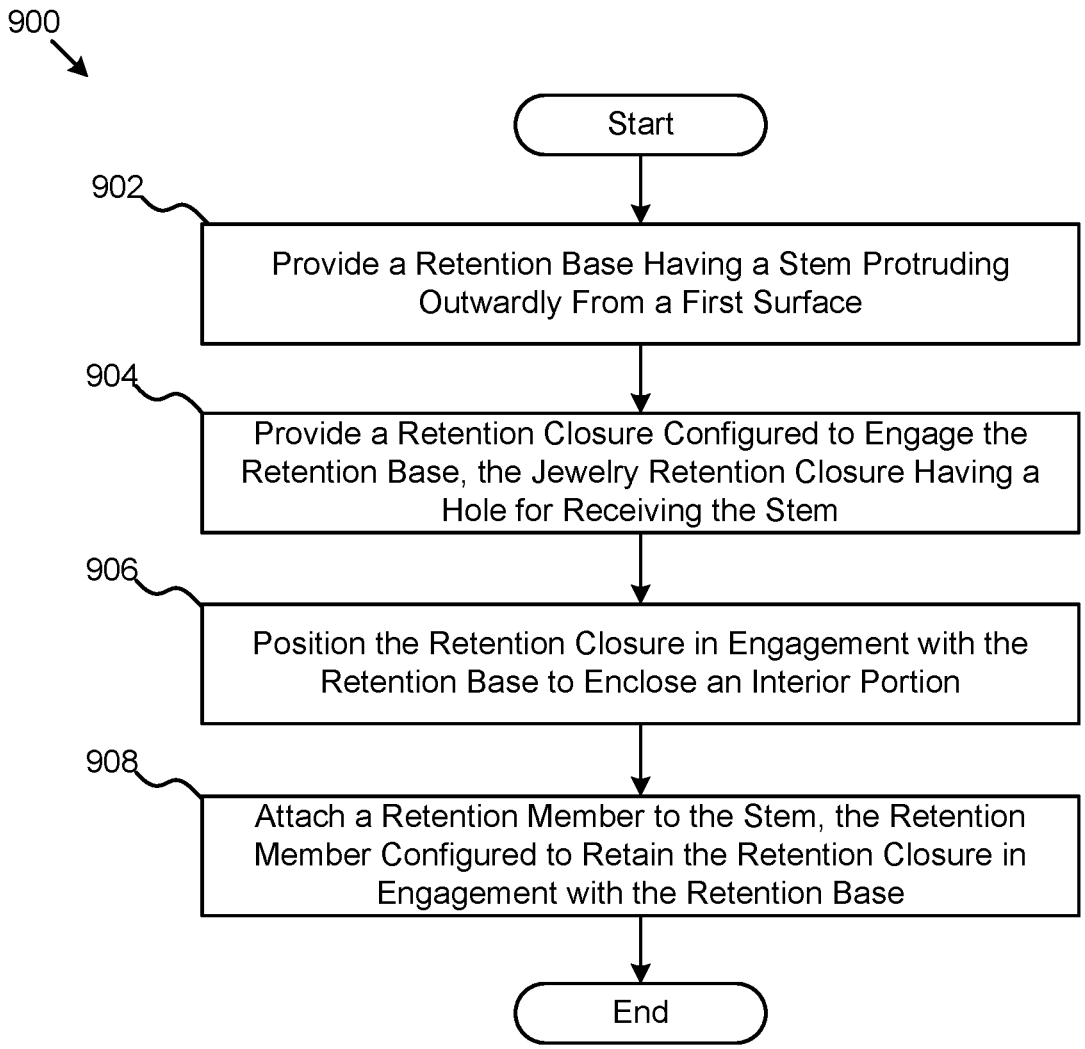

FIG. 9 is a flowchart diagram illustrating one embodiment of a method for using a retention device.

Figure 10:
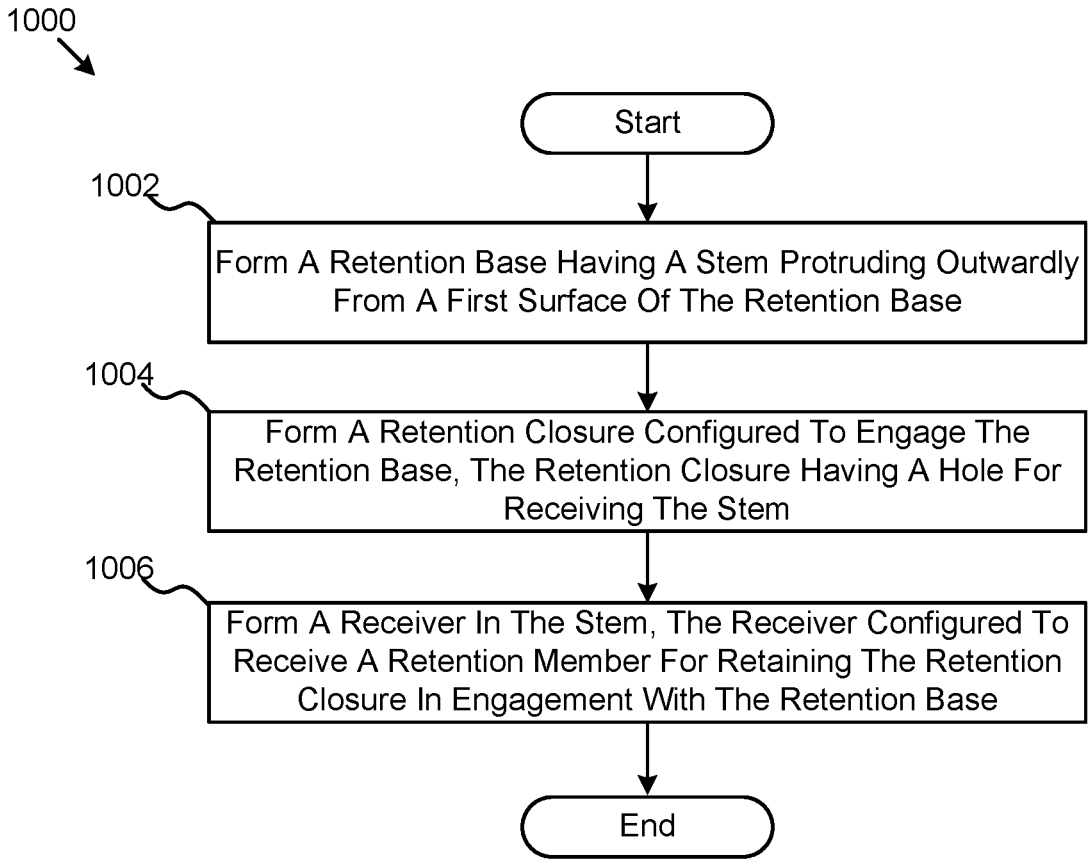

FIG. 10 is a flowchart diagram illustrating one embodiment of a method of manufacturing a retention device.

Figure 11:
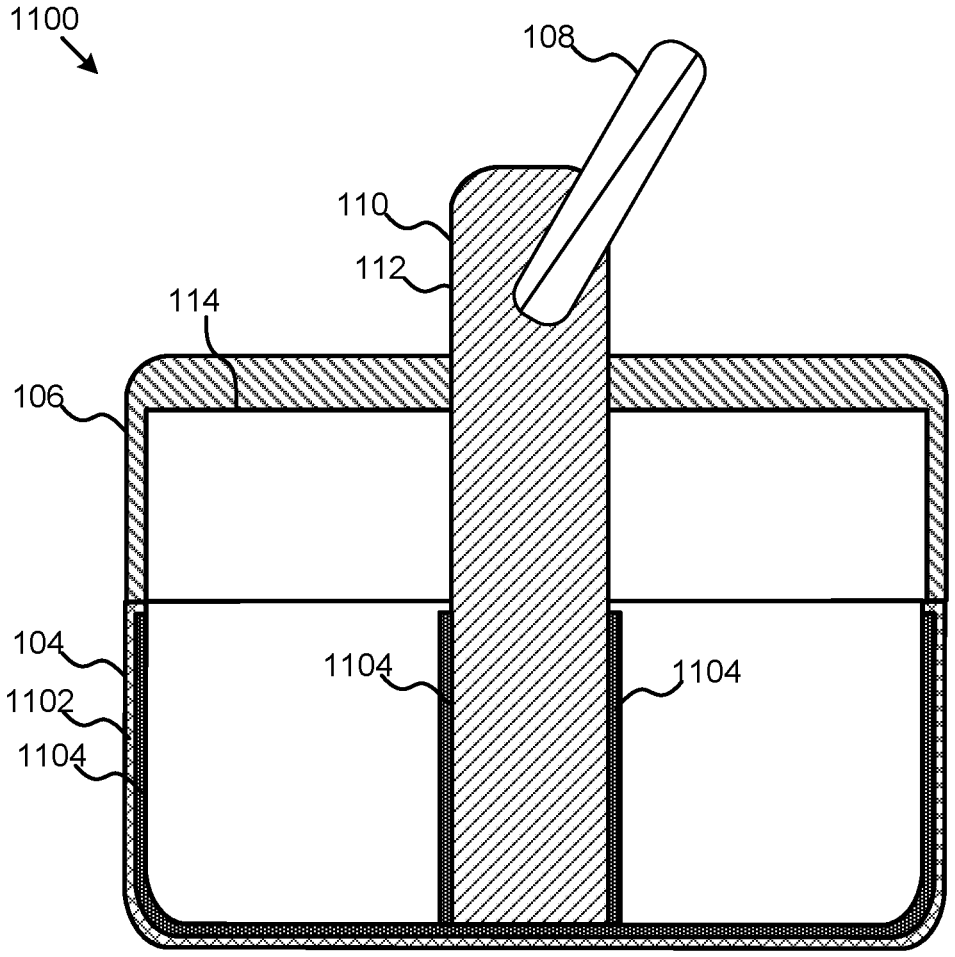

FIG. 11 is a cross-section view of a further embodiment of a retention device.

DETAILED DESCRIPTION

The invention now will be described more fully hereinafter with reference to the accompanying drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. One skilled in the art may be able to use the various embodiments of the invention.

FIG. 1 is a cross-section view diagram illustrating one embodiment of a retention device 100. In an embodiment, the retention device 100 includes a retention base 104, a retention closure 106, and a retention member 108. An article of jewelry 102 may be inserted into the retention base 104 and captured therein by the retention closure 106. The retention member 108 may be configured to retain the retention closure 106 in engagement with the retention base 104.

Jewelry 102 may be a ring as illustrated in FIG. 1. One of ordinary skill will recognize that various forms and types of jewelry may be enclosed in the retention device 100 of FIG. 1. For example, the jewelry 102 may include gemstones. In other embodiments, the jewelry 102 may be earrings, necklaces, bracelets, and the like. One of ordinary skill will recognize the that the article of jewelry 102 may be replaced with other articles, such as medication tablets, vitamins, protein shake powder, fitness supplements, or the like. In other embodiments, the retention device may be shaped to receive hearing aids, earplugs, earbuds earphones, or the like. Indeed, one of ordinary skill will recognize a variety of articles that may be contained within the retention device.

In an embodiment, the retention base 104 may include, a stem 110, and a flange 114. The retention base 104 may be configured to receive jewelry 102. For example, the retention base 104 may be cylinder shaped, box shaped, egg shaped or other various shapes configured to receive various shapes of jewelry 102, or other valuables. In an embodiment, the retention base 104 may be made from various types of plastic. In such embodiments, the retention base 104 may be injection molded from a thermosetting polymer. In other embodiments, the retention base 104 may be manufactured from metals, such as aluminum, brass, steel, or the like. In such an embodiment, the retention base 104 may be forged from aluminum. In another embodiment, the retention base 104 may be machined from stainless steel stock, or stamped from steel or other metals and metal alloys.

In an embodiment, the retention closure 106, when engaged with the retention base 104 and seated upon the flange 114, may contain the jewelry 102. The retention closure 106 can be manufactured in similar ways as discussed above according to the retention base 104.

In an embodiment, the stem 110 may extend outwardly from the retention base 104. The stem 110 may extend far enough outwardly that it protrudes from the retention closure 106. The stem 110 may include a receiver 112. The receiver 112 may receive a retention member 108 locking the engagement of the retention closure 106 and the retention base 104. The stem 110 can be manufactured in similar ways as discussed above according to the retention base 104.

In an embodiment, the receiver 112 may be a hole in the portion of the stem 110 that is protruding from the retention closure 106. The receiver 112 may receive a retention member 108 locking the engagement of the retention closure 106 and the retention base 104 securely locking in the jewelry 102 inside the retention device 100. The retention member 108 may include various diverse embodiments, such as the examples described below with relation to FIGS. 6-8. One of ordinary skill will recognize any number of suitable retention members 108 for use with the present embodiments, including bracelets, necklaces, straps, bands, clamps, pins, rings, and the like.

FIG. 2 is an exploded view diagram illustrating one embodiment of a retention device 100. The retention base 104 is configured to receive jewelry 102. The retention closure 106 is the seated upon the flange 114 capturing the jewelry 102 therein. The receiver 112, which is disposed on the portion of the stem 110 protruding from the retention closure 106, may receive a retention member 108, as illustrated in FIG. 3, thereby locking the retention closure 106 in engagement with the retention base 104.

FIG. 4 is a perspective view diagram illustrating one embodiment of a retention base 104. The retention base 104 and a base housing 404 may form a receptacle. In an embodiment, the receptacle may be cylindrical shaped. Alternatively, the receptacle may be box shaped, or the like. There may be a first surface 402 which the jewelry 102 may be inserted upon. The retention base 104 a mated portion for connection to the retention closure 106, thereby capturing jewelry 102. In an embodiment, the retention base 104 may be a receptacle. The retention base 104 may be cylindrical shaped, box shaped, prism shaped, or the like. In various embodiments, the receiver 112 may be a groove, notch, recess, or other structure suitable for receiving the retention member 108. One of ordinary skill will recognize a variety of receiver configurations, which may operate in conjunction with the retention member 108 to positively lock the retention closure 106 in engagement with the retention base 104.

One of ordinary skill will recognize that the first surface 402 of the retention base 104 may have various outer dimensions and geometries. For example, the first surface may be generally round, square, rectangular, triangular, hexagonal, etc. Similarly, one of ordinary skill will recognize that the retention closure 106 may similarly have various dimensions and geometries. Indeed, the geometries may be varied, so long as the retention base 104 and the retention closure 106 are configured to engage.

FIG. 5 illustrates aspects of the retention closure 106. The stem 110 may protrude from the hole 504 disposed in the second surface 502 of the retention closure 106 as shown in FIG. 3. The retention closure 106 includes a mated portion for connection to the retention base 104 capturing jewelry 102. The hole 504 may be circular shaped, square shaped, rectangle shaped, and the like. In an embodiment, there may be a closure housing 506. The closure housing 506 may be configured according to the form of the retention base 104 or flange 114.

FIG. 6 is a perspective view diagram illustrating one embodiment of a retention member 108. The retention member 108 may include a carabiner body 602 that may include a pivotal clamp 604. The carabiner body 602 may be received by the receiver 112 and locked by the clamp 604. In another embodiment as shown in FIG. 7, the retention member 108 may be a pair of clamping jaws 704 with a lever 706 connected to one clamping jaw 704. That body may be connected to a ring 702. In still another embodiment as shown in FIG. 8, the retention member 108 may be a retractable clamp 802 that may be connected to an actuator 804. That body may be connected to a ring 702.

FIG. 9 is a flowchart diagram illustrating one embodiment of a method 900 for using a retention device 100. In an embodiment, the retention device 100 may provide a retention base 104 having a stem 110 protruding outwardly from a first surface 402 as shown in block 902. At block 904, the method 900 may also include providing a retention closure 106 configured to engage the retention base 104, the retention closure 106 having a hole 504 for receiving the stem 110. At block 906, the method 900 may include positioning the retention closure 106 in engagement with the retention base 104 to enclose an interior portion. At block 908, the retention member 108 may be attached to the stem 110, the retention member 108 configured to retain the retention closure 106 in engagement with the retention base 104.

FIG. 10 is a flowchart diagram illustrating one embodiment of a method 1000 of manufacturing a retention device 100. In an embodiment, the method 1000 includes forming a retention base having a stem protruding outwardly from a first surface of the retention base, as shown at block 1002. Additionally, the method 1000 may include forming a retention closure configured to engage the retention base, the retention closure having a hole for receiving the stem, as shown at block 1004. The method 1000 may also include forming a receiver in the stem, the receiver configured to receive a retention member for retaining the retention closure in engagement with the retention base, as shown at block 1006.

In further embodiments, forming the retention device 100 may include steps for injection molding the retention base and stem, and the retention closure from polymer or other plastics materials. In another embodiment, the retention device 100 may be manufactured from metal materials, including stainless steel, aluminum, metal alloys, etc. In come embodiments, the components of the retention device 100 may be cast in molds. Alternatively, a forging or stamping process may be used. In still other embodiments, a combination of manufacturing processes and materials may be used. For example, in a further embodiment, some or all of the components may be formed by casting or molding silicon in molds, or the like. One of ordinary skill will recognize a variety of alternative materials and methods which may be used to manufacture the present embodiments.

FIG. 11 illustrates a further embodiment of a retention device 1100. In the embodiment of FIG. 11, the retention device may include a liner 1104 attached to an inner surface of the retention base 104. In such an embodiment, the liner 1104 may be disposed on an interior surface of a margin 1102 of material defining a wall of the retention base 104, as well as the surface of the stem 110. In a further embodiment, the liner 1104 may be disposed on a surface of the retention closure 106. In an alternative embodiment, the liner 1104 may be disposed on an outer surface of the retention device, and configured to protect the retention device from damage, or from damaging other articles.

The liner 1104 may be a spray-on material, such as silicon or rubber. Alternatively, the liner 1104 may be glued on. The liner 1104 may be manufactured from a variety of materials, including felt, neoprene, or other protective materials.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

What is claimed is:

1. A retention device, comprising:

a cylindrical retention base comprising:

a bottom, a first cylindrical wall extending around and upwardly from the bottom and terminating at a rim, and a stem coupled to the bottom and extending upwardly therefrom, the stem having an apex located above the rim;

and a cup-shaped closure having a second wall with an inner surface and an outer surface, wherein the inner surface and the apex of the stem are spaced with respect to one another to prevent passage of objects located within the retention device when the cup-shaped closure and retention base are coupled together;

wherein the outer surface of the cup-shaped closure most proximal to the retention base is flush with an outer surface of the retention base when the cup-shaped closure is coupled to the retention base.

2. The retention device of claim 1, wherein the outer surface of the retention base comprises at least one rounded corner when the cup-shaped closure is coupled to the retention base.

3. The retention device of claim 1, wherein the retention base is configured to be coupled to a retention member via a hole through its thickness that is distal from the junction.

4. The retention device of claim 3, wherein the hole is through the apex of the stem.

5. The retention device of claim 1, wherein the stem substantially extends along an axis centrally located within the cup-shaped closure when the cup-shaped closure and the retention base are coupled together.

6. The retention device of claim 1, further comprising a flexible liner coupled to the stem.

7. The retention device of claim 2, further comprising a flexible liner coupled to the stem.

8. The retention device of claim 3, further comprising a flexible liner coupled to the stem.

9. The retention device of claim 5, further comprising a flexible liner coupled to the stem.

10. An accessory retention method, comprising the steps of:

engaging a retention base with a cup-shaped closure, wherein the retention base comprises:

a cylindrical bottom having a central axis and at least one rounded corner at a radius from the central axis, a first wall extending around and upwardly from the bottom and terminating at a rim, and a stem coupled to the bottom and extending upwardly therefrom along the central axis, the stem having an apex located above the rim, and the cup-shaped closure has a second wall with an inner surface and an outer surface; and locking the retention base into the cup-shaped closure to form a flush surface between a junction between the retention base and the cup-shaped closure.

11. The retention method of claim 10, further comprising the step of disposing a liner along the stem, wherein the liner is selected from the group consisting of rubber, felt, neoprene, silicone, or combinations of the same.

12. The retention method of claim 11, wherein the step of disposing the liner includes disposing the liner above the retention base.

13. The retention method of claim 12, wherein the step of disposing the liner further includes disposing the liner so that it contacts the first wall and the stem simultaneously.

* * * * *